US009834919B1

(12) United States Patent
Shabat

(10) Patent No.: US 9,834,919 B1
(45) Date of Patent: Dec. 5, 2017

(54) LAVATORY ACCESSORY POSITIONING DEVICE

(71) Applicant: Reuven Shabat, Sherman Oaks, CA (US)

(72) Inventor: Reuven Shabat, Sherman Oaks, CA (US)

( * ) Notice: Subject to any disclaimer, the term of this patent is extended or adjusted under 35 U.S.C. 154(b) by 0 days.

(21) Appl. No.: 15/639,161

(22) Filed: Jun. 30, 2017

Related U.S. Application Data

(60) Provisional application No. 62/374,728, filed on Aug. 12, 2016.

(51) Int. Cl.

| | |
|---|---|
| ***A47K 17/00*** | (2006.01) |
| ***E03D 9/00*** | (2006.01) |
| ***E03D 9/03*** | (2006.01) |
| ***A47K 13/24*** | (2006.01) |
| *E03D 9/08* | (2006.01) |

(52) U.S. Cl.
CPC ..... *E03D 9/002* (2013.01); *A47K 13/24* (2013.01); *E03D 9/032* (2013.01); *E03D 9/08* (2013.01)

(58) Field of Classification Search
CPC ..... E03D 9/002; E03D 9/032; E03D 9/08; A47K 13/24; A47K 1/09; A47K 11/10; B44D 3/123; A46B 17/02; A47B 81/02; A47L 13/512; A47G 29/08
USPC ..... 4/661
See application file for complete search history.

(56) References Cited

U.S. PATENT DOCUMENTS

| | | | | | |
|---|---|---|---|---|---|
| 903,596 | A * | 11/1908 | Martin et al. | A47K 13/06 | 297/464 |
| 1,453,959 | A * | 5/1923 | Thomas | A47K 1/09 | 312/206 |
| 1,566,860 | A * | 12/1925 | Hainzigianis | A47K 1/09 | 206/362.1 |
| 2,701,702 | A * | 2/1955 | Diederich | A47K 17/00 | 248/112 |
| 2,703,407 | A * | 3/1955 | Henoch | A47K 13/24 | 248/205.5 |
| 4,116,332 | A * | 9/1978 | Hartley | B44D 3/12 | 206/209 |
| 4,383,339 | A * | 5/1983 | Miller | E03D 9/08 | 4/420.4 |
| 4,909,467 | A * | 3/1990 | Shan-Pao | A47G 23/0241 | 211/75 |

(Continued)

*Primary Examiner* — Benjamin R Shaw
(74) *Attorney, Agent, or Firm* — Bradley C. Fach; Steven R. Kick; PatentFile, LLC

(57) ABSTRACT

A lavatory accessory positioning device may include a support bracket having an aperture which may be used to couple the device to a toilet. A support pole may be coupled to the support bracket, and the support pole may be movable between an extended position and a retracted position. A support platform may be coupled to the support pole. A hanger bracket may be coupled to the support platform, and the hanger bracket may be movable between a horizontal position and a vertical position. The hanger bracket may have a distal accessory holder which may be configured to removably couple a lavatory accessory to the device. When a lavatory accessory is coupled to the distal accessory holder and the support pole is in the extended position and the hanger bracket is in the horizontal position, the lavatory accessory may be positioned above a portion of the toilet to which the device is coupled.

19 Claims, 9 Drawing Sheets

(56) References Cited

U.S. PATENT DOCUMENTS

| | | | | | |
|---|---|---|---|---|---|
| 5,063,618 | A * | 11/1991 | Souka | E03D 9/08 | 4/420.4 |
| 5,116,003 | A * | 5/1992 | Gerhardt | A47L 13/512 | 248/113 |
| 5,322,256 | A * | 6/1994 | Kanwischer | A47L 13/512 | 211/65 |
| 5,996,952 | A * | 12/1999 | Heywood | A46B 17/02 | 248/110 |
| 6,419,194 | B1 * | 7/2002 | Losacco | A46B 17/02 | 248/110 |
| 6,883,189 | B2 * | 4/2005 | Pierce | E03D 9/00 | 4/255.11 |
| 6,959,914 | B1 * | 11/2005 | Corral | E03C 1/021 | 251/293 |
| 2005/0145757 | A1 * | 7/2005 | Brown | B44D 3/123 | 248/110 |
| 2006/0243685 | A1 * | 11/2006 | Monroig | A47K 1/09 | 211/65 |
| 2013/0056596 | A1 * | 3/2013 | Wilbs | A47L 13/512 | 248/205.1 |

* cited by examiner

LAVATORY ACCESSORY POSITIONING DEVICE

CROSS REFERENCE TO RELATED APPLICATIONS

This application claims priority to and the benefit of the filing date of U.S. Provisional Application No. 62/374,728 filed on Aug. 12, 2016 entitled "Devices for Disinfecting and Drying a Toilet-Brush Within a Toilet-Bowl", which is hereby incorporated by reference in its entirety.

FIELD OF THE INVENTION

This patent specification relates to the field of devices and systems configured to facilitate the maintenance of toilets and toilet areas. More specifically, this patent specification relates to devices configured to position lavatory accessories to provide a sanitary and organized toilet and toilet environment.

BACKGROUND

The toilet-brush is an essential tool for keeping good sanitation of a toilet-bowl. Due to the matters coming in contact with the toilet-brush, in reality, a user will not let it leave the vicinity of the toilet-bowl after use, but rather insert it into its storage-container, which is usually coupled with the brush as a set and can be found next to every household toilet. The lack of means to maintain the sanitation of the toilet-brush after use, leaving those who care with the options to immerse the brush-head into a disinfecting solution mixed with the water at the water-reservoir of the toilet-bowl, shake the brush within the interior of the toilet-bowl, tack and balance it in between the toilet-seat and the edge of the toilet-bowl for dripping and drying. When not done so, the brush is inserted into the storage-container and often will still be wet and dripping upon retrieval at next use.

A toilet-brush has a densely arranged large amount of bristles that traps large amount of water and other sediments and when stored in the storage-container with lack of air ventilation, creates environment which can promote and lead to growth of fungus, bacteria, algae, mold and other hazardous and unhealthy conditions to humans and pets. That also results in the need to often maintain the cleanliness of the storage-container, which in reality left neglected. Due to not having the proper tools for disinfecting and drying the toilet-brush in the immediate area of the toilet-bowl, in an easy and effective way, it creates an exception to the rule that otherwise is not skipped when it comes to storage of items involving wetness and in this case fecal matters as well, which may be referred to as "The toilet-brush global epidemic". The invention described herein is dedicated to solve those conflicting problems, will change the perception on how a toilet-brush needs to be maintained and promote safe and healthy living for generations to come.

Therefore a need exists for a novel toilet maintenance devices and systems which promote safe and healthy living for generations to come. There is also a need for novel toilet maintenance devices and systems which prevent the creation of an environment which can promote and lead to growth of fungus, bacteria, algae, mold and other hazardous and unhealthy conditions to humans and pets. A further need exists, for novel toilet maintenance devices and systems which are able to position a toilet-brush after use to dry and maintain the sanitation of the toilet-brush. Finally, a need exists for novel toilet maintenance devices and systems which are able to facilitate the ability of a user to clean a toilet and to maintain an organized toilet area.

BRIEF SUMMARY OF THE INVENTION

A lavatory accessory positioning device is provided which is configured to be coupled to an object, such as a toilet, and to removably couple and position a lavatory accessory, such as a toilet brush, above the object, such as above the bowl of a toilet. When the device is not in use it may be compacted so as to preferably be out of view while remaining coupled to the object.

In some embodiments, the device may include a support bracket having an aperture which may be used to couple the device to a toilet. A support pole may be coupled to the support bracket, and the support pole may be movable between an extended position and a retracted position. A support platform may be coupled to the support pole. A hanger bracket may be coupled to the support platform, and the hanger bracket may be movable between a horizontal position and a vertical position. The hanger bracket may have a distal accessory holder which may be configured to removably couple a lavatory accessory to the device. When a lavatory accessory is coupled to the distal accessory holder and the support pole is in the extended position and the hanger bracket is in the horizontal position, the lavatory accessory may be positioned above a portion of the toilet to which the device is coupled. When a lavatory accessory is not coupled to the distal accessory holder and the support pole is in the retracted position and the hanger bracket is in the vertical position, the device may be positioned under and/or behind a portion of the toilet to which the device is coupled so that the device may be out of sight.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
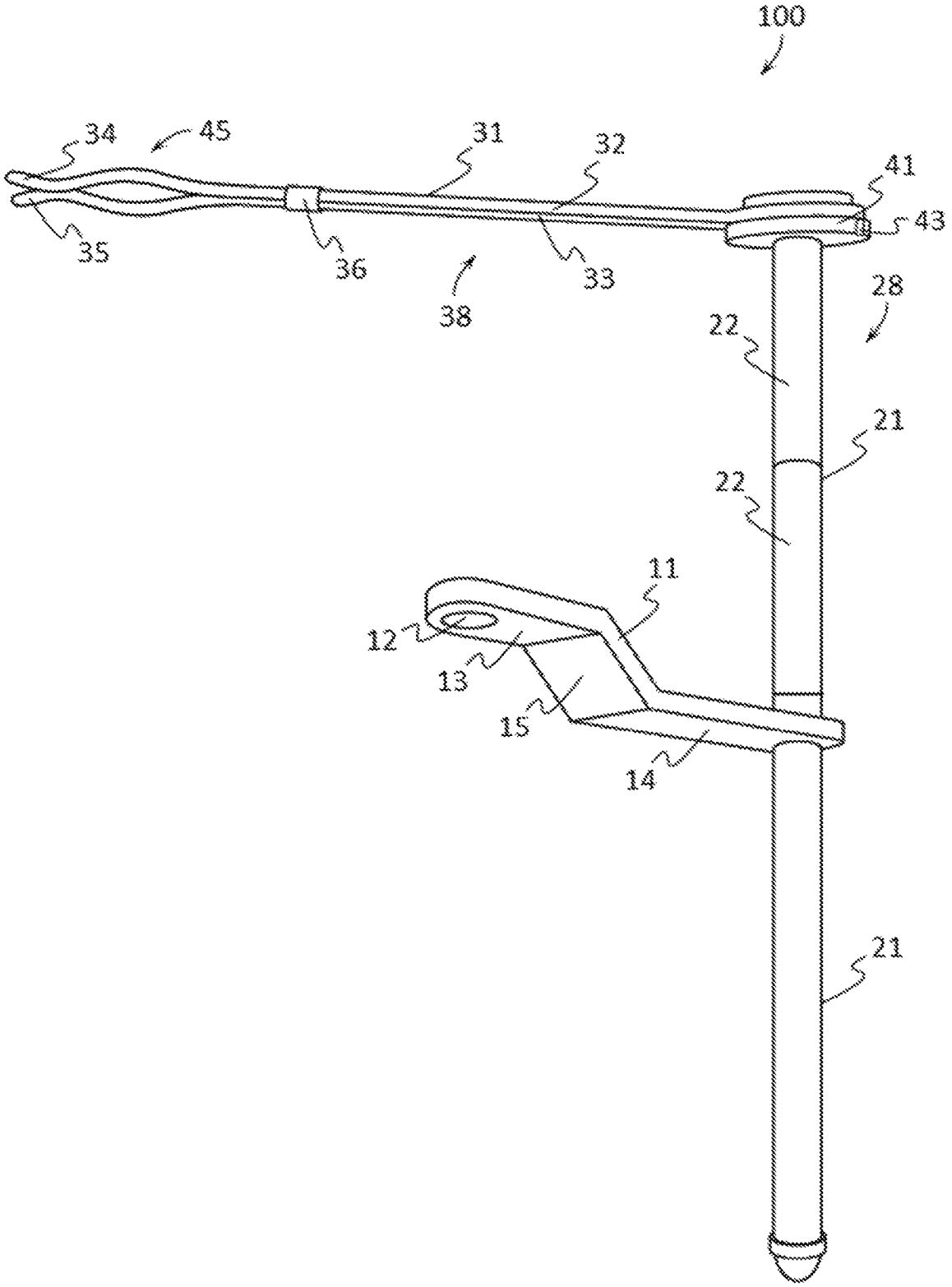
FIG. 1 depicts a perspective view of an example of a lavatory accessory positioning device according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

New devices configured to position lavatory accessories are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 illustrates an example of a lavatory accessory positioning device ("the device") 100 according to various embodiments. In some embodiments, the device 100 may comprise a support bracket 11 having an aperture 12. A support pole 21 may be coupled to the support bracket 11, and the support pole 21 may be movable between an extended position 28 and a retracted position 29. A support platform 41 may be coupled to the support pole 21. A hanger bracket 31 may be coupled to the support platform 41, and the hanger bracket 31 may be movable between a horizontal position 38 and a vertical position 39. The hanger bracket 31 may have a distal accessory holder 45 which may be configured to removably couple a lavatory accessory 200 (FIGS. 2 and 3) to the device 100.

Figure 2:
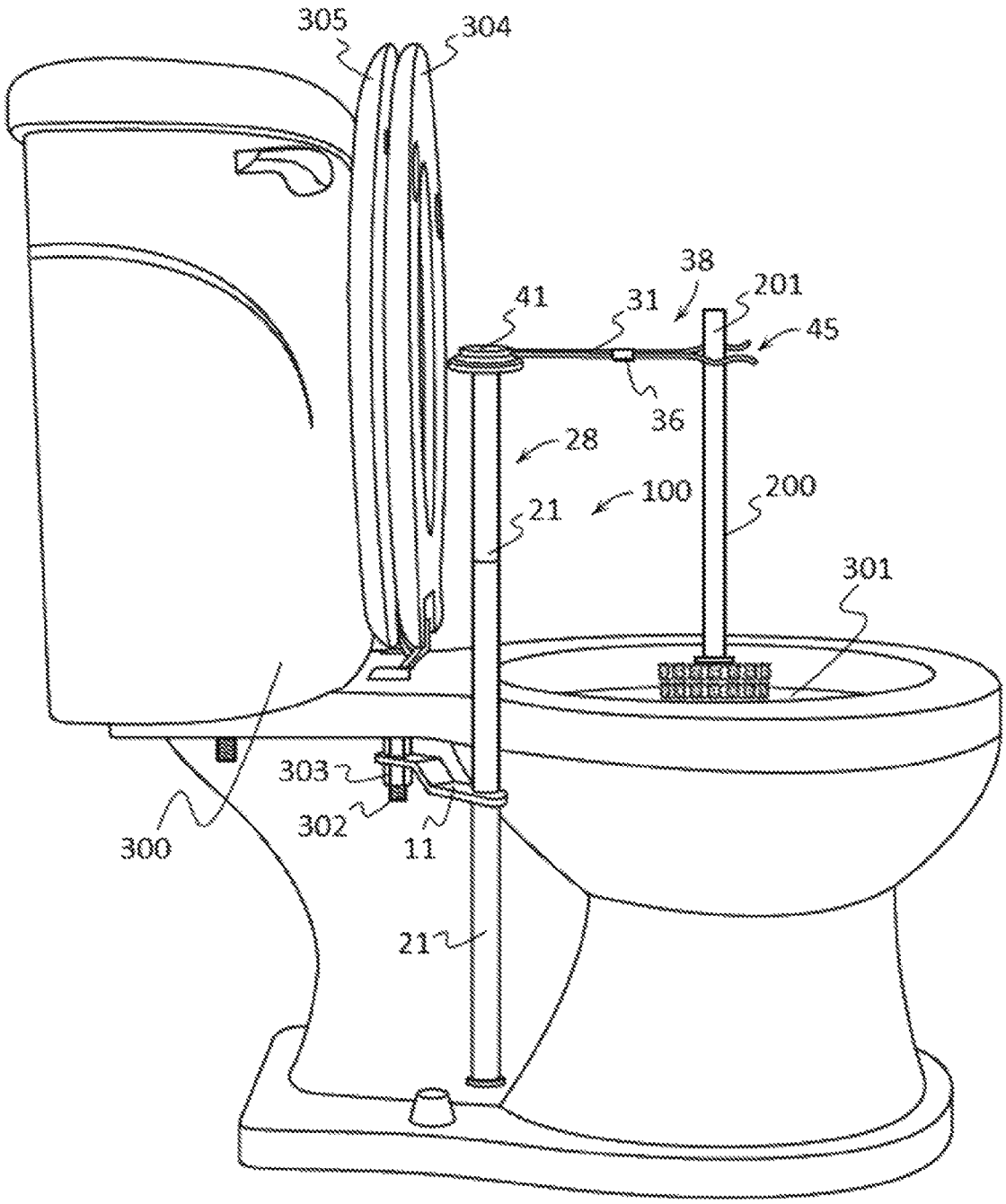
FIG. 2 illustrates a perspective view of an example of a lavatory accessory positioning device coupled to a toilet having a support pole in an extended position and a hanger bracket in a horizontal position, the support bracket coupled to a lavatory accessory above the bowl of the toilet, according to various embodiments described herein.
Figure 3:
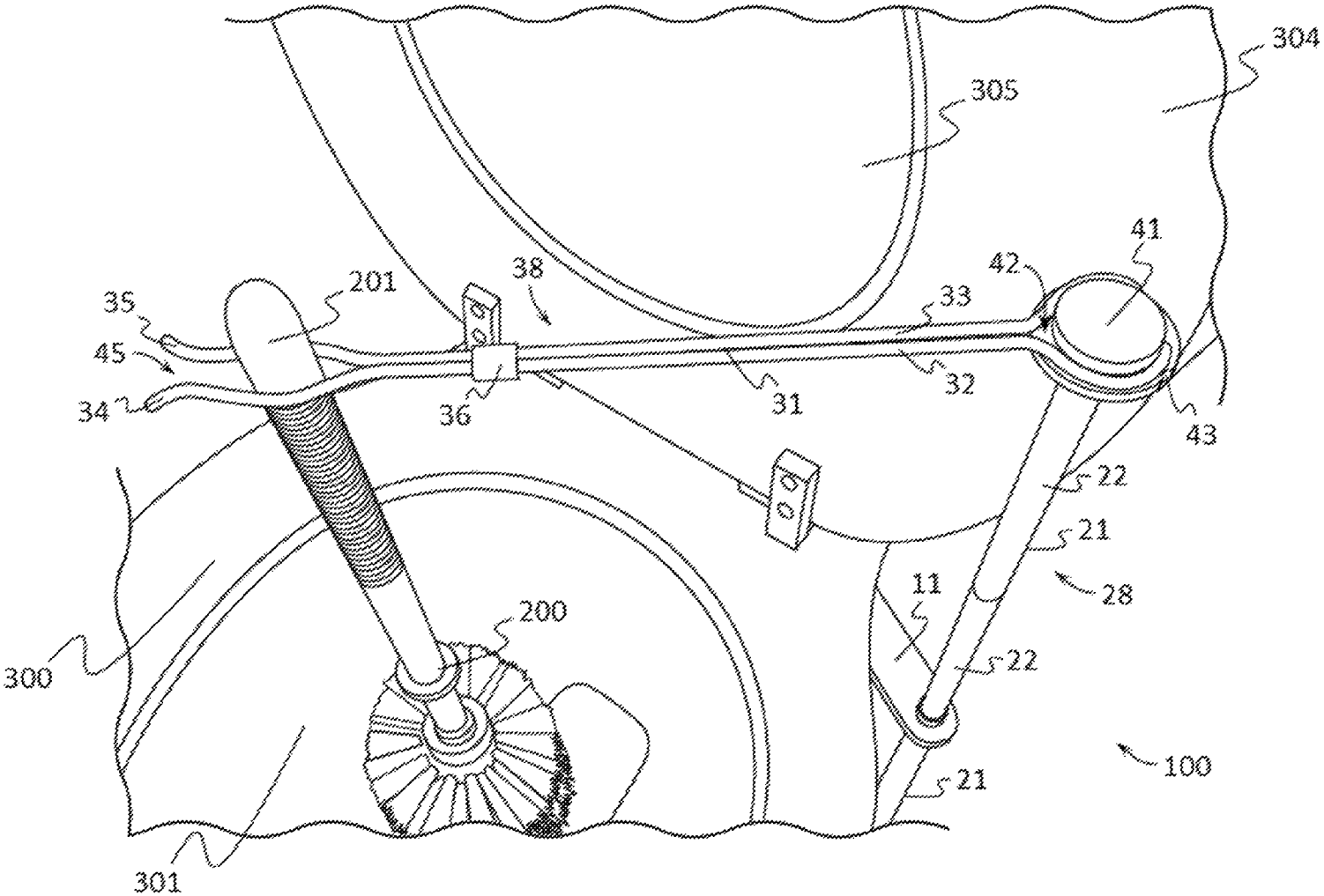
FIG. 3 shows a top perspective view of an example of a lavatory accessory positioning device coupled to a toilet and positioning a lavatory accessory above the bowl of the toilet according to various embodiments described herein.
Figure 4:
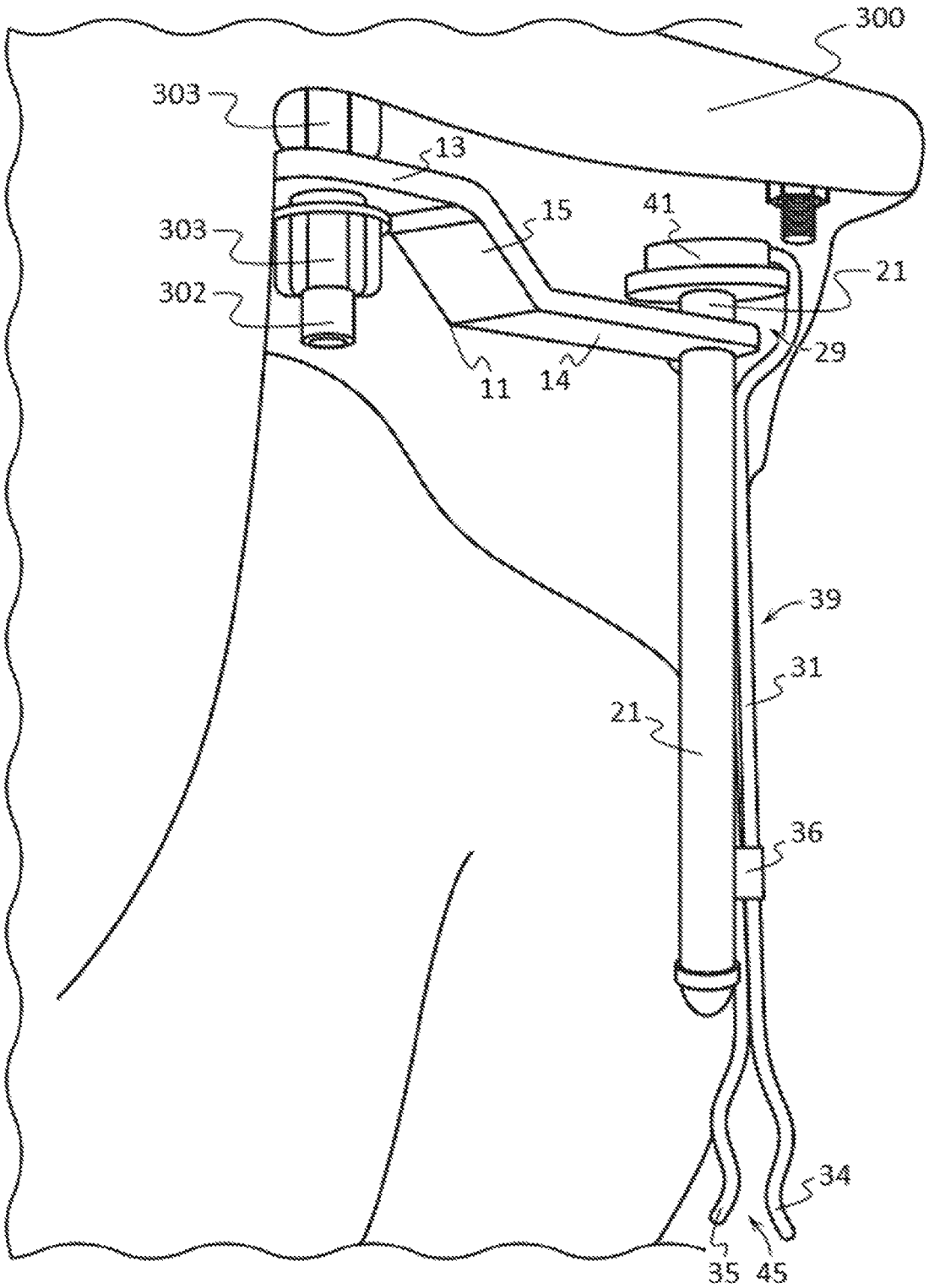
FIG. 4 depicts a bottom perspective view of an example of a lavatory accessory positioning device coupled to a toilet having a support pole in a retracted position and a hanger bracket in a vertical position according to various embodiments described herein.

The device 100 may comprise one or more support brackets 11 which may be configured to couple the device 100 to an object such as a toilet 300 (FIGS. 2-4). The support bracket 11 may be made from any durable and substantially rigid material or combination of materials such as steel alloys, aluminum, aluminum alloys, copper alloys, any other type of metal or metal alloy, any type of ceramic, earthenware, natural stone, synthetic stone, various types of hard plastics, such as polyethylene (PE), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid.

In some embodiments, the device 100 may comprise an aperture 12 which may pass through the support bracket 11 and shaped to allow a male fastener 302 (FIG. 4) to be inserted through the aperture 12. One or more male fasteners 302, bushings, and/or female fasteners 303 (FIG. 4) may be used to couple the support bracket 11 to an object such as a toilet 300 via one or more apertures 12. An aperture 12 may be generally circular in shape, rectangular in shape, or configured in any other shape and/or size.

The support bracket 11 may comprise an elongated shape having a support aperture 12 at one end and a support pole 21 coupled to the support bracket 11 at the opposing end. In preferred embodiments, the support bracket 11 may comprise a proximal section 13 and a distal section 14. The proximal section 13 may form the portion of the support bracket 11 into which an aperture 12 may be formed and the distal section 14 may form the portion of the support bracket 11 to which the support pole 21 may be coupled. Optionally, the proximal section 13 may extend above the distal section 14. For example, the support bracket 11 may comprise a medial section 15 which may separate the proximal section 13 from the distal section 14, and the medial section 15 may be angled so that the proximal section 13 may be extended above the distal section 14. In other embodiments, the support bracket 11 may be linear, curved, or otherwise shaped to enable a proximal section 13 to be level with, above, or below a distal section 14.

The device 100 may comprise one or more support poles 21 which may be coupled to a support bracket 11. A hanger bracket 31 and/or support platform 41 may also be coupled to a support pole 21, and the support pole 21 may be used to separate and position the hanger bracket 31 and/or support platform 41 relative to the support bracket 11. A support pole 21 may comprise any type of elongated structure such as a rod, pole, shaft, or mast. In some embodiments, a support pole 21 may comprise one or more telescoping sections 22 which may be positioned or disposed between a support bracket 11 and the hanger bracket 31 and/or support platform 41. A telescoping section 22 may allow the hanger bracket 31 and/or support platform 41 to be moved towards and away from the support bracket 11. For example, a support pole 21 may comprise one or more telescoping sections 22 or segments which may be retracted into and extended from each other. The telescoping sections 22 may be transitioned between an extended position 28 (FIGS. 1-3), in which the hanger bracket 31 and/or support platform 41 is relatively farther from the support bracket 11, and a retracted position 29 (FIG. 4), in which the hanger bracket 31 and/or support platform 41 is relatively closer to the support bracket 11. Optionally, a knob 37 (FIGS. 5 and 6) or other hand graspable object may be coupled to the support platform 41 which may be manipulated by a user to raise and lower the support platform 41 via the telescoping section(s) 22.

The device 100 may comprise one or more hanger brackets 31 which may be configured to hold a lavatory accessory 200 and to allow the lavatory accessory 200 to be positioned relative to the support bracket 11 and therefore relative to a toilet 300 that the device 100 may be coupled to. In some embodiments, a hanger bracket 31 may be pivotally coupled to a support platform 41 so that the hanger bracket 31 may be pivoted or rotated relative to the support platform 41 between the horizontal position 38 and the vertical position 39. A hanger bracket 31 may be made in various shapes, sizes, and durable materials such as metal, metal alloys, plastics, wood, and the like. Preferably, the hanger bracket 31 may be formed by a length of elongated material which may be bent, formed, molded, or otherwise fabricated to form the elements of the hanger bracket 31.

In some embodiments, a hanger bracket 31 may comprise one or more arms, such as a first arm 32 and a second arm 33. An arm 32, 33, may be pivotally coupled to a support pole 21, optionally via a support platform 41, and the arm 32, 33, may be configured to be removably coupled to a lavatory accessory 200. In further embodiments, a hanger bracket 31 may comprise a single arm, such as the first arm 32, pivotally coupled to the support platform 41 with another arm, such as the second arm 33, coupled to the first arm 32 between the portion of the first arm 32 coupled to the support platform 41 and the distal accessory holder 45 portion of the first arm 32. A tensioner 36 may be coupled to both arms 32, 33, which the second arm 33 also forming part of the distal accessory holder 45. In this manner, a hanger bracket 31 may comprise a distal accessory holder 45 formed by portions of both arms 32, 33, with the hanger bracket 31 coupled to the support platform 41 at a single location.

Figure 9:
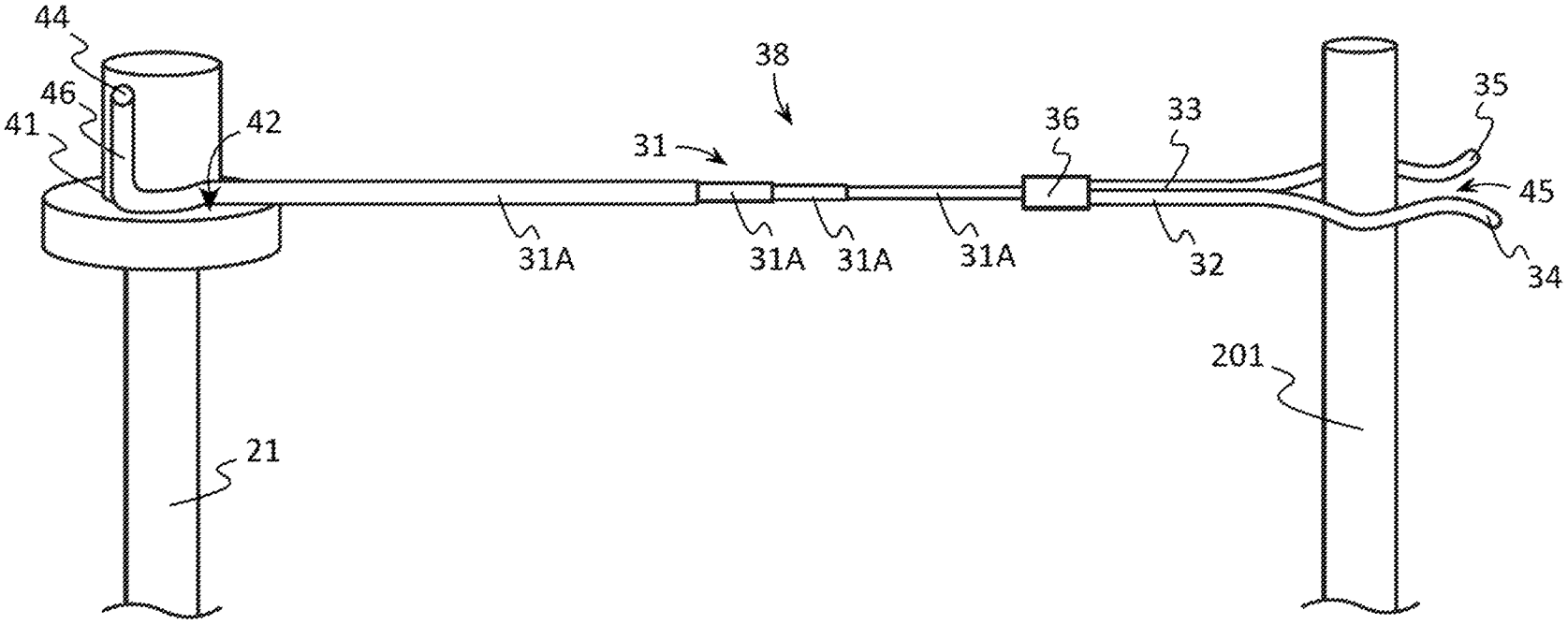
FIG. 9 shows a partial perspective view of an alternative example of a lavatory accessory positioning device coupled to a toilet and positioning a lavatory accessory according to various embodiments described herein.

Generally, an arm 32, 33, may comprise an elongated structure which may be used to position a distal accessory holder 45 from the hanger bracket 31 and/or support platform 41 to which the arm 32, 33, may be coupled. For example, an arm 32, 33, may comprise a length of metal wire, plastic tubing, or any other elongated structure which may be used to separate a distal accessory holder 45 from the hanger bracket 31 and/or support platform 41 to which the arm 32, 33, may be coupled. In further embodiments and as shown in FIG. 9, a hanger bracket 31 may comprise one or more telescoping bracket sections 31A which may be movable relative to each other to allow the distal accessory holder 45 to be moved towards and away from the support platform 41. For example, one or more bracket sections 31A may be configured to retract into and extend from one or more other bracket sections 31A in a telescoping manner to allow the distal accessory holder 45 to be moved towards and away from the support platform 41. In other embodiments, a bracket section 31A may be movably coupled to another bracket section 31A, a first arm 32 and/or a second arm 33, or a tensioner 36 with any other suitable method to enable to length of the hanger bracket 31 to be lengthened or shortened. In still further embodiments, any element of the hanger bracket 31, such as the prongs 34, 35, arms 32, 33, or any other section of the hanger bracket 31, may be configured to extend from and retract into another section of the hanger bracket 31 that that element may be coupled to in a telescoping manner, which may eliminate the need for a tensioner 36 while still providing the same adjustment features of a tensioner 36.

The hanger bracket 31 may comprise a distal accessory holder 45 which may be formed by portions of one or more arms 32, 33, and which may couple a lavatory accessory 200 to the hanger bracket 31. A distal accessory holder 45 may be configured to removably couple or secure a lavatory accessory 200 to the device 100. In preferred embodiments, a first arm 32 may comprise a first prong 34 and a second arm 33 comprise a second prong 35 which may be both form a distal accessory holder 45 by being adapted to removably clasp a handle 201 of a lavatory accessory 200. For example, a first prong 34 and a second prong 35 may be configured to flex apart when a handle 201 of a lavatory accessory 200 is positioned between the prongs 34, 35, so that the prongs 34, 35, may be tensioned against the handle 201 to frictionally secure the handle 201 in the distal accessory holder 45.

In alternative embodiments, a distal accessory holder 45 may comprise any type of removable attachment method which may be used to removably couple or secure a lavatory accessory 200 to the device 100, such as a J-hook with hanging loop type fastener, a magnetic fastener, a turn to lock connection method, or any other suitable removable attachment method. In still further embodiments, a distal accessory holder 45 may be formed by an arm 32, 33, having a prong 34, 35, which may be inserted through a hole, hook, or other opening which may be found on a handle 201 or other portion of a lavatory accessory 200 to removably couple or secure a lavatory accessory 200 to the device 100.

Figure 8:
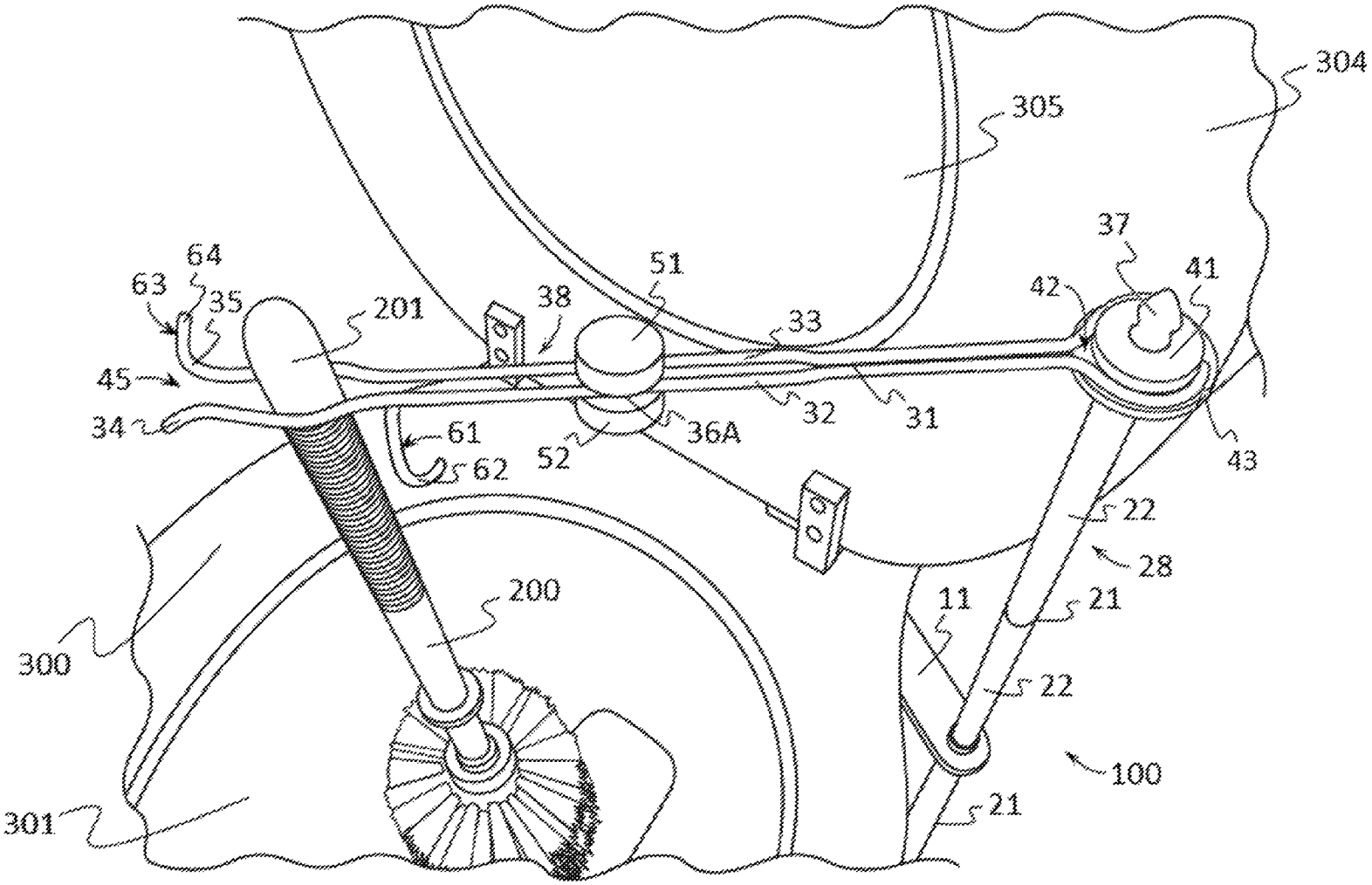
FIG. 8 illustrates a top perspective view of still another example of a lavatory accessory positioning device coupled to a toilet and positioning a lavatory accessory above the bowl of the toilet according to various embodiments described herein.

In some embodiments and as shown in FIG. 8, the hanger bracket 31 may comprise a trigger surface 61 and/or a pad surface 63. A trigger surface 61 may facilitate the insertion of a handle 201 or other element of a lavatory accessory 200 into the distal accessory holder 45 and may be disposed on an insertion trigger 62 or otherwise formed onto an arm 32, 33, such as the first arm 32, of the hanger bracket 31. Generally, an insertion trigger 62 may comprise a protrusion onto which a trigger surface 61 may be formed that extends down below an arm 32, 33, and preferably parallel with the support pole 21. A trigger surface 61 may be contacted by a finger, such as an index finger, and used to hold the hanger bracket 31 steady by counter balancing the pushing force as a handle 201 or other element of a lavatory accessory 200 is inserted into the distal accessory holder 45.

A pad surface 63 may facilitate the extraction of a handle 201 or other element of a lavatory accessory 200 from the distal accessory holder 45 and may be disposed on an extraction pad 64 or otherwise formed onto an arm 32, 33, such as the second arm 33, of the hanger bracket 31. Generally, an extraction pad 64 may comprise a protrusion on a prong 34, 35, such as the second prong 35, onto which a pad surface 63 may be formed that extends away from the opposing prong 34, 35, such as the first prong 34. A pad surface 63 may be contacted by a finger, such as a thumb, and used to counter balance the pulling force exerted against the extended support pole 21 and the hanger bracket 31, to facilitate the extraction of the handle 201 or other element of a lavatory accessory 200 from the distal accessory holder 45. Optionally, an insertion trigger 62 may comprise a hook shape, J-shape, or any other shape which may enable the insertion trigger 62 to be utilized as a hanging point for a lavatory accessory 200 such as a brush/plunger with a hanging hole or a hanging string at the handle 201 by placing the hanging hole or hanging string onto the hook shaped insertion trigger 62.

One skilled in the art will recognize that a trigger surface 61 and a pad surface 63 may be disposed on either or both arms 32, 33, to facilitate their use by right and left handed individuals. Additionally, the shapes of the trigger surface 61, insertion trigger 62, pad surface 63, and extraction pad 64 shown in FIG. 8 are exemplary and in other embodiments, trigger surface 61, insertion trigger 62, pad surface 63, and extraction pad 64 may be configured in any other shape and size.

In some embodiments, the device 100 may comprise one or more tensioners 36 which may be coupled to two arms 32, 33, and which may be configured to tension portions of the arms 32, 33, together. Optionally, portions of the arms 32, 33, may be slightly flexible and/or flexibly coupled to the hanger bracket 31 and/or support platform 41 so that the arms 32, 33, may be flexed towards and away from each other. In further embodiments and as shown in FIGS. 1-4, a tensioner 36 may couple the arms 32, 33, together thereby limiting or governing the distance the arms 32, 33, may be flexed apart and therefore governing the tension that the prongs 34, 35, may be tensioned against the handle 201 to frictionally retain the handle 201 in the distal accessory holder 45. The tensioner 36 may be movably coupled to the first arm 32 and second arm 33, such as by extending or wrapping around portions of the arms 32, 33, so that the tensioner 36 may be moved towards and away from the distal accessory holder 45. By positioning the tensioner 36 closer to the distal accessory holder 45, the amount of tension or frictional engagement between a handle 201 and the distal accessory holder 45 may be increased, optionally allowing the distal accessory holder 45 to accommodate smaller sized or shaped handles 201. Conversely, by positioning the tensioner 36 relatively farther from the distal accessory holder 45, the amount of tension or frictional engagement between a handle 201 and the distal accessory holder 45 may be relatively decreased, optionally allowing the distal accessory holder 45 to accommodate relatively larger sized or shaped handles 201.

Figure 5:
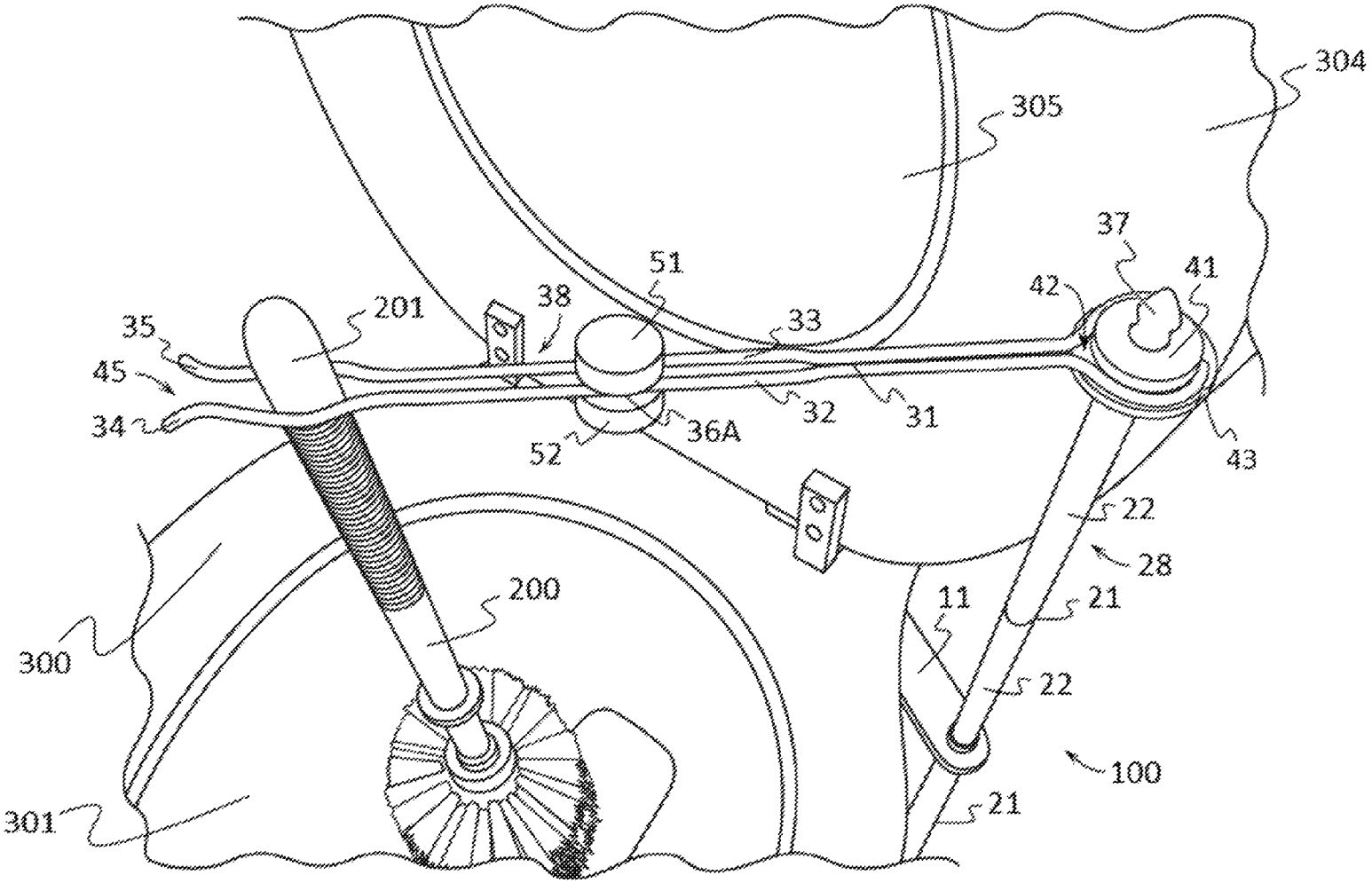
FIG. 5 illustrates a top perspective view of another example of a lavatory accessory positioning device coupled to a toilet and positioning a lavatory accessory above the bowl of the toilet according to various embodiments described herein.
Figure 6:
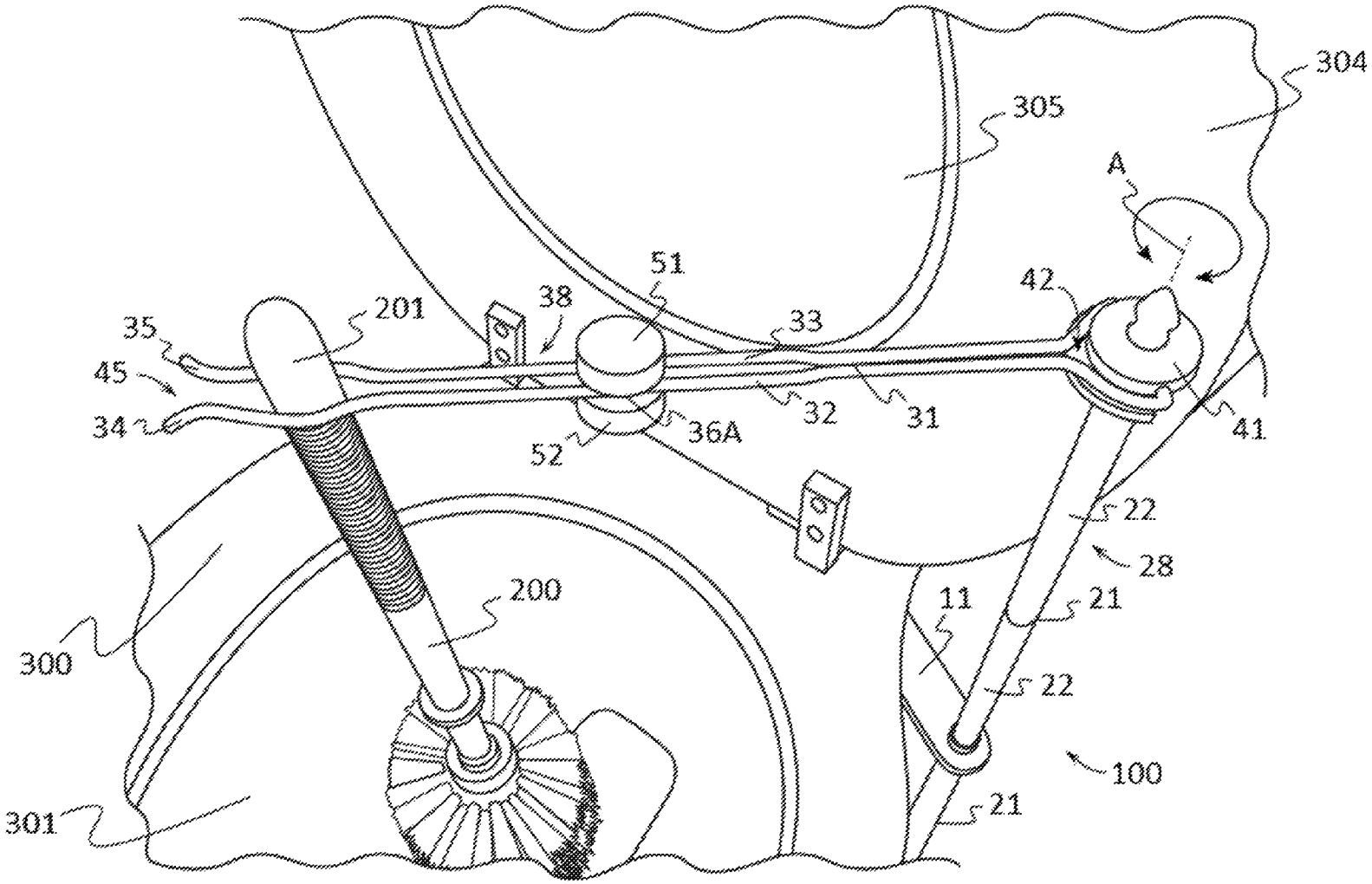
FIG. 6 shows a top perspective view of a further example of a lavatory accessory positioning device coupled to a toilet and positioning a lavatory accessory above the bowl of the toilet according to various embodiments described herein.
Figure 7:
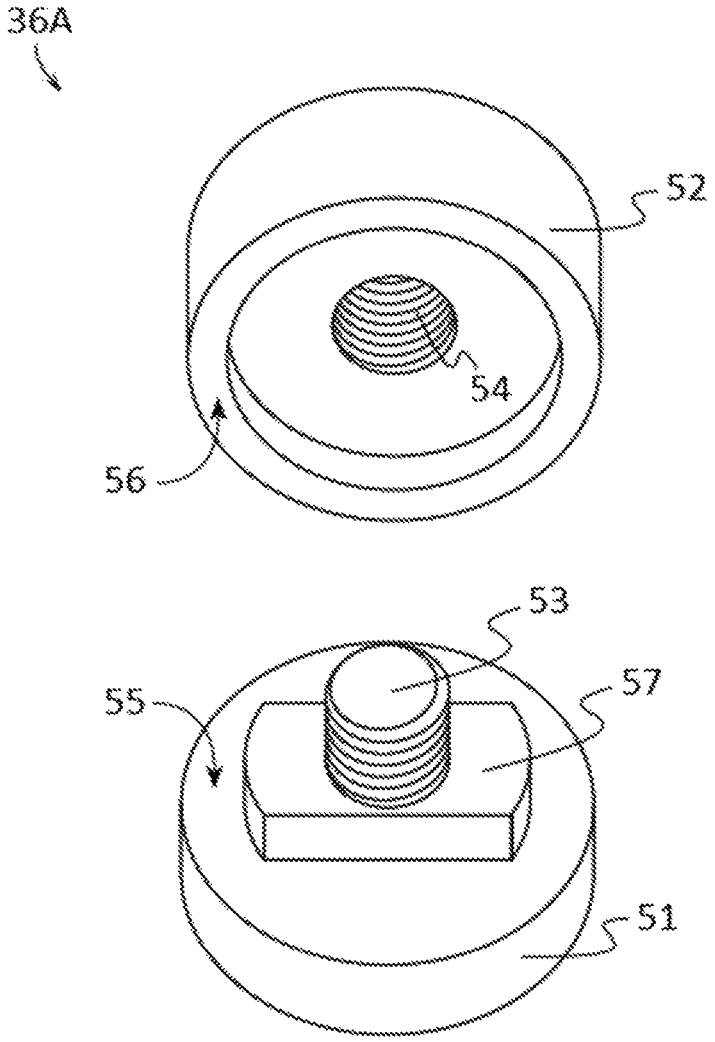
FIG. 7 depicts a perspective exploded view of an adjustable tensioner according to various embodiments described herein.

In alternative embodiments and as shown in FIGS. 5-7, a tensioner 36 may be an adjustable tensioner 36A which may comprise a first section 51 and a second section 52 which may be removably and/or movably coupled together with one or more fasteners, such as a male fastener 53 and a female fastener 54. An adjustable tensioner 36A may be positioned in different locations along the arms 31, 32, and may also have a cam lobe 57 that can spread the two arms 31, 32, and change the distance between the prongs 34, 35. When used with a lavatory accessory 200 having a pommel on the handle 201, the cam lobe 57 may separate the prongs 34, 35, a distance which allows for a free entrance of the handle 201 between the prongs 34, 35, and for the resting of the pommel on the prongs 34, 35, to support the accessory 200 rather than requiring the handle 201 to be clasped between the prongs 34, 35.

In some embodiments, a male fastener 53 and a female fastener 54 may be threaded fasteners which may allow the first section 51 and second section 52 to be removably coupled together and/or movably coupled together so that the distance between the sections 51, 52, may be changed or governed by the threaded engagement between the fasteners 53, 54. In other embodiments, the sections 51, 52, may be coupled together with any other suitable type of fastener(s). Preferably, the tensioner 36A may comprise a first surface 55, a second surface 56, and a cam lobe 57. A first surface 55 may be disposed on the first section 51, a second surface 56 may be disposed on the second section 52, and a cam lobe 57 may be disposed on either or both sections 51, 52.

An adjustable tensioner 36A may be engaged to the arms 32, 33, by inserting the male fastener 53 and cam lobe 57 between the arms 32, 33, and then coupling the female fastener 54 to the male fastener 53. The cam lobe 57 may separate the arms 32, 33, and the distance of separation may be governed by the size and shape of the cam lobe 57 so that by rotating the cam lobe 57 between the arms 32, 33, the cam lobe 57 may push the arms 32, 33, apart and allow the arms 32, 33, to flex back together. Additionally, by tightening the fasteners 53, 54, the first surface 55 and second surface 56 may be brought closer together to grip opposing sides of the arms 32, 33, to maintain the position of the adjustable tensioner 36A on the arms 32, 33.

Optionally, the device 100 may comprise a support platform 41 which may couple the hanger bracket 31 to the support pole 21. In some embodiments, a support platform 41 may be coupled to the upper end of the support pole 21 and may pivotally secure the hanger bracket 31 to the support pole 21. The support platform 41 may be coupled to the hanger bracket 31 and may support the hangar bracket 31 generally perpendicular to the support pole 21 while the hanger bracket 31 is in the extended position 38. Preferably, a support platform 41 may comprise a support surface 42 (FIG. 3) upon which a hanger bracket 31 may rest and be supported while in the horizontal position 38. In some embodiments, a support surface 42 may be configured with a generally annular planar shape, while in other embodiments, a support surface 42 may be formed by a bump, protrusion, or other structure upon which a hanger bracket 31 may rest and be supported while in the horizontal position 38. A support platform 41 and support surface 42 may each be made of many different shapes and/or combinations of shapes. The support platform 41 may comprise a width or diameter which may be larger than the width or diameter of the support pole 21. Similarly, the support surface 42 may also comprise a width or diameter which may be larger than the width or diameter of the support pole 21. In preferred embodiments, the support platform 41 and support surface 42 have a width or diameter larger than the width or diameter of the support pole 21, the hanger bracket 31 may be moved into the extended position 38 and supported by the support surface 42 without requiring a user to manipulate one or more fasteners in order to fasten or secure the hanger bracket 31 in the extended position 38.

In further embodiments, the support platform 41 may comprise a hanger recess 43 (FIGS. 3 and 5) which may be shaped an indent, depression, or recess and configured to receive portions of the hanger bracket 31 (but not the entire hanger bracket 31 or an entire arm 32, 33, of a hanger bracket 31) when the hanger bracket 31 is collapsed downward in a vertical position 39 parallel to the support pole 21. For example, portions of the hanger bracket 31, such as portions of a first 32 and/or second 33 arm, may rest on or be supported by the support platform 41 as shown in FIGS. 2 and 3 when the hanger bracket 31 is in the horizontal position 38, and once pivoted, portions of the hanger bracket 31, such as portions of a first 32 and/or second 33 arm, may be supported by a support surface 42 and may also be received in one or more shaped hanger recesses 43 as shown in FIGS. 1 and 3 when the hanger bracket 31 is in the vertical position 39. Optionally, and as shown in FIG. 6, a support surface 42 may be positioned to support portions of a first 32 and/or second 33 arm when the hanger bracket 31 is in the horizontal position 38 and when the hanger bracket 31 is pivoted over the support platform 41, the support platform 41 may not interfere or contact the hanger bracket 31 when the hanger bracket 31 is in the vertical position 39 (FIG. 4).

In still further embodiments and as shown in FIG. 9, a hanger bracket 31 may be pivotally coupled to a support platform 41 and be configured to be pivoted between the horizontal position 38 and vertical position 39 without requiring a hanger recess 43 on the support platform 41 to provide a recess or depression in the support platform 41 for receiving portions of the hanger bracket 31. For example, the hanger bracket 31 may comprise a lateral extension 46 which may separate the pivotal coupling 44 from a portion of the hanger bracket 31, such as a bracket section 31A, a distance that is greater than the support surface 42. By rotating the hanger bracket 31 up and over the support platform 41, the lateral extension 46 may position the hanger bracket 31 a sufficient distance away from the support surface 42 so that the hanger bracket 31 may be moved into the vertical position 39 as shown in FIG. 4.

The support platform 41, and therefore the hanger bracket 31, may be configured to pivot or rotate around axis A (FIG. 6). In some embodiments, the support platform 41 may be pivotally coupled to the support pole 21 so that by pivoting or rotating portions of the support platform 41, the hanger bracket 31, and therefore a distal accessory holder 45, coupled to the support platform 41 may be pivoted or rotated relative to the support pole 21. In further embodiments, the hanger bracket 31 may be pivotally coupled to the support platform 41 so that by pivoting or rotating portions of the hanger bracket 31, the hanger bracket 31 and therefore a distal accessory holder 45, may be pivoted or rotated relative to the support platform 41. Optionally, the support platform 41 may be pivotally coupled to the support pole 21, a telescoping section 22 may be pivotally coupled to another telescoping section 22, and/or the support pole 21 may be pivotally coupled to the support bracket 11 to enable the support platform 41, and therefore the hanger bracket 31, to pivot or rotate around axis A. In preferred embodiments, the hanger bracket 31 may be movably coupled to the device 100 so that the hanger bracket 31, and therefore a distal accessory holder 45, may be pivoted or rotated relative to the support bracket 11. In further embodiments, all or portions of the support pole 21 may be pivotally coupled to the support bracket 11 so that by pivoting or rotating portions of the support pole 21, the hanger bracket 31, and therefore a distal accessory holder 45, coupled to the support pole 21 may be pivoted or rotated relative to the support bracket 11. In still further embodiments, the hanger bracket 31 may be pivotally coupled to the support pole 21 so that by pivoting or rotating portions the hanger bracket 31, the hanger bracket 31, and therefore a distal accessory holder 45, may be pivoted or rotated relative to the support pole 21.

FIGS. 2 and 3 illustrate an example of a lavatory accessory positioning device 100 that is coupled to a toilet 300 and that is supporting a lavatory accessory 200 above portions of the toilet 300. In this and preferred embodiments, the support pole 21 may be movable into an extended position 28 in which the portion of the support pole 21 to which the hanger bracket 31 is coupled, optionally via a support platform 41, and the portion of the support pole 21 to which the support bracket 11 is coupled may be positioned relatively farther away from each other. For example, one or more telescoping sections 22 may be fully extended from each other. The hanger bracket 31 may also be movable into a horizontal position 38 in which the hanger bracket 31 may be generally perpendicularly oriented relative to the support pole 21. Preferably, the hanger bracket 31 may be movably coupled to the device 100 so that the distal accessory holder 45 may be pivoted or rotated relative to the support bracket 11 and pivoted over the bowl 301 of the toilet 300. In this example, a lavatory accessory 200, such as a toilet brush, may be removably coupled to the distal accessory holder 45 by positioning a portion of the lavatory accessory 200, such as the handle 201, between the prongs 34, 35, of the arms 32, 33, which may be tensioned towards each other with a movable tensioner 36, thereby allowing the prongs 34, 35, of the arms 32, 33, to frictionally engage with the lavatory accessory 200 to support the lavatory accessory 200 above the bowl 301 of the toilet 300 when the support pole 21 is in the extended position 28 and the hanger bracket 31 is in the horizontal position 38. In other embodiments, a distal accessory holder 45 may removably couple a lavatory accessory 200 to the device 100 with any suitable method, thereby allowing the prongs 34, 35, and/or arms 32, 33, to frictionally engage with the lavatory accessory 200 to support the lavatory accessory 200 above the bowl 301 of the toilet 300 when the support pole 21 is in the extended position 28 and the hanger bracket 31 is in the horizontal position 38.

FIG. 4 depicts an example of a lavatory accessory positioning device 100 that is coupled to a toilet 300 in which the support pole 21 is in a retracted position 29 and the hanger bracket 31 is in a vertical position 39. In this and preferred embodiments, the support pole 21 may be movable into a retracted position 29 in which the portion of the support pole 21 to which the hanger bracket 31 is coupled, optionally via a support platform 41, and the portion of the support pole 21 to which the support bracket 11 is coupled may be positioned relatively closer to each other. For example, one or more telescoping sections 22 may be fully retracted into another telescoping section 22. The hanger bracket 31 may also be movable into a vertical position 39 in which the hanger bracket 31 may be generally oriented parallel to the support pole 21. Preferably, the hanger bracket 31 may be movably coupled to the device 100 so that the distal accessory holder 45 may be pivoted or rotated relative to the support bracket 11 and pivoted away from being over the bowl 301 of the toilet 300. Preferably, the device 100 may be coupled to the toilet 300 with a male fastener 302 that has been inserted through an aperture 12 of the support bracket 11 and with one or more female fasteners 303 which may be coupled to the male fastener 302.

Typical of many toilets 300, one or more threaded bolt type male fasteners 302 along with a bushing are used with one or more threaded nut type female fasteners 303 to secure the seat 304 (FIGS. 2 and 3) and/or lid 305 (FIGS. 2 and 3) to the toilet. In this example, the aperture 12 may be placed over the bolt type male fastener 302 and secured thereto with a nut type female fastener 303 along with the bushing which may allow the support bracket 11 to be pivotally coupled to the toilet 300 so that when the support pole 21 is in a retracted position 29 and the hanger bracket 31 is in a vertical position 39, portions of the device 100 may be pivoted under and/or behind portions of the toilet 300 so as to be generally out of view. Preferably, the support bracket 11 may comprise a proximal section 13 which may extend above the distal section 14 so that when the support pole 21 is in a retracted position 29 and the hanger bracket 31 is in a vertical position 39, a support platform 41 may be able to be positioned under and/or behind portions of the toilet 300 so as to be generally out of view.

While some preferred shapes and configurations of the elements of the device 100 have been provided, it should be understood to one of ordinary skill in the art that the support bracket 11, support pole 21, hanger bracket 31, support platform 41, and any element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A lavatory accessory positioning device, the device comprising:

a support bracket having an aperture, the support bracket adapted to be coupled to a toilet having a bowl, and;

a support pole coupled to the support bracket, the support pole movable between an extended position and a retracted position;

a support platform coupled to the support pole; and a hanger bracket coupled to the support platform, the hanger bracket movable between a horizontal position and a vertical position, and the hanger bracket having a distal accessory holder, wherein the distal accessory holder is configured to removably couple a lavatory accessory to the device and wherein the distal accessory holder is configured to removably couple the lavatory accessory above the bowl when the support pole is in the extended position and the hanger bracket is in the horizontal position.

2. The device of claim 1, wherein the support pole is pivotally coupled to the support bracket.

3. The device of claim 1, wherein the hanger bracket is pivotally coupled to the support platform.

4. The device of claim 1, wherein the support pole comprises a telescoping section.

5. The device of claim 1, wherein the hanger bracket comprises a telescoping bracket section.

6. The device of claim 1, wherein the hanger bracket comprises a first arm and a second arm, and wherein the first arm and second arm are tensioned together with a tensioner.

7. The device of claim 6, wherein the tensioner is movably coupled to the first arm and second arm.

8. The device of claim 1, wherein the hanger bracket comprises a trigger surface and a pad surface.

9. The device of claim 1, wherein the distal accessory holder comprises a first prong and a second prong which are both adapted to removably secure a handle of a lavatory accessory.

10. The device of claim 1, wherein the support bracket comprises a proximal section and a distal section, and wherein the proximal section extends above the distal section.

11. A lavatory accessory positioning device, the device comprising:

a support bracket having an aperture;

a support pole coupled to the support bracket, the support pole movable between an extended position and a retracted position;

a support platform coupled to the support pole; and a hanger bracket coupled to the support platform, the hanger bracket movable between a horizontal position and a vertical position, and the hanger bracket having a distal accessory holder, wherein the support bracket is adapted to be coupled to a toilet, and wherein the distal accessory holder is configured to removably couple a lavatory accessory above a portion of the toilet when the support pole is in the extended position and the hanger bracket is in the horizontal position.

12. The device of claim 11, wherein the support pole is pivotally coupled to the support bracket.

13. The device of claim 11, wherein the hanger bracket is pivotally coupled to the support platform.

14. The device of claim 11, wherein the support pole comprises a telescoping section.

15. The device of claim 11, wherein the hanger bracket comprises a telescoping bracket section.

16. The device of claim 15, wherein the hanger bracket comprises a first arm and a second arm, and wherein the first arm and second arm are tensioned together with a tensioner.

17. The device of claim 16, wherein the tensioner is movably coupled to the first arm and second arm.

18. The device of claim 11, wherein the distal accessory holder comprises a first prong and a second prong which are both adapted to removably secure a handle of a lavatory accessory.

19. The device of claim 11, wherein the support bracket comprises a proximal section and a distal section, and wherein the proximal section extends above the distal section.

* * * * *